United States Patent [19]

Atsumi et al.

[11] Patent Number: 4,715,146

[45] Date of Patent: Dec. 29, 1987

[54] APPARATUS FOR CLOSING FIREPROOF DOORS

[75] Inventors: Haruyuki Atsumi, Kanagawa; Hisatugu Anzai, Tokyo; Noboru Kasahara, Hiroshima, all of Japan

[73] Assignees: Ryobi Limited, Hiroshima; Hochiki Corporation, Shinagawa, both of Japan

[21] Appl. No.: 894,449

[22] Filed: Aug. 1, 1986

Related U.S. Application Data

[63] Continuation of Ser. No. 645,921, Aug. 30, 1984.

[30] Foreign Application Priority Data

Sep. 8, 1983 [JP] Japan ..... 58-139355[U]

[51] Int. Cl.[4] ..... E05F 15/20

[52] U.S. Cl. ..... 49/1; 16/48.5; 49/2

[58] Field of Search ..... 16/48.5; 49/1, 2, 5, 49/13, 379; 292/DIG. 66, 273, 274, 263

[56] References Cited

U.S. PATENT DOCUMENTS

| | | | |
|---|---|---|---|
| 2,171,365 | 8/1939 | Harding | 49/2 |
| 2,352,843 | 7/1944 | Lewis | 49/2 X |
| 2,665,129 | 1/1954 | Durbin et al. | 49/1 X |
| 3,729,770 | 5/1973 | Lasier | 292/273 X |
| 3,771,823 | 11/1973 | Schnarr | 49/1 |
| 3,964,125 | 6/1976 | Tansley | 49/1 X |
| 4,040,143 | 8/1977 | Lasier | 292/273 X |

FOREIGN PATENT DOCUMENTS

| | | | |
|---|---|---|---|
| 2310701 | 3/1973 | Fed. Rep. of Germany | 16/48.5 |
| 2417619 | 10/1979 | France | 16/48.5 |

*Primary Examiner*—Peter A. Aschenbrenner
*Attorney, Agent, or Firm*—Frishauf, Holtz, Goodman & Woodward

[57] ABSTRACT

An apparatus is disclosed for releasably locking a fireproof door in an open position. A latch mechanism includes a hook connected to the door. The hook is releasably engaged with an actuator plate swingable between a latching position and a release position. Its motion is restricted by resilient means having bias adjustment means. A toggle mechanism keeps the actuator plate in its latching position until the toggle mechanism is struck by a remote-controlled solenoid plunger to release the door and let it close. If the solenoid malfunctions, the door can be closed manually with a force dependent on the setting of the bias adjustment means.

8 Claims, 7 Drawing Figures

APPARATUS FOR CLOSING FIREPROOF DOORS

This application is a continuation of application Ser. No. 645,921, filed 8/30/84.

BACKGROUND OF THE INVENTION

This invention relates to an apparatus for closing a fireproof door, normally locked in its open position, in case of emergency such as fire either by remote-controlled energization of a solenoid or with a manual closing force.

In a prior art closing apparatus, a slider normally latched by a latch mechanism is released by remote-controlled energization of a solenoid in case of fire and the door is automatically closed by, for instance, a door closer.

It is desired, however, to manually release a slider from a latch mechanism so as to close the door manually, thereby assuring a reliable operation even when a solenoid malfunctions.

Further, in the prior art closing apparatus, latching force of the latch mechanism is normally set to a level higher than necessary to prevent a slider from becoming unintentionally released. It is desired, also, to make it possible to adjust the latching force of the latch mechanism since manual closing becomes difficult when latching force of the latch mechanism is excessive.

SUMMARY OF THE INVENTION

Accordingly, an object of the invention is to provide an improved closing apparatus wherein a latching force of a latch mechanism applied to a slider is adjustable.

According to this invention, a fireproof door closing apparatus is provided, wherein the fireproof door is hinged to a door frame and is swingable to its closing position from its opening position by a door closer secured to the fireproof door. The apparatus includes a locking device secured to the door frame and including a latch mechanism and a slider. A link mechanism is interconnected between the door closer and the locking device. The latch mechanism includes a solenoid, a toggle link mechanism, and an actuator plate. The actuator plate is resiliently supported by a spring with adjustment screw adapted to adjust the resilient force of the spring. A fulcrum shaft provides a fulcrum around which the actuator plate rotates. The said slider includes a slide hook having a hook portion adapted to be disengageably engaged with a pin on the actuator plate.

DESCRIPTION OF PREFERRED EMBODIMENT

Figure 1:
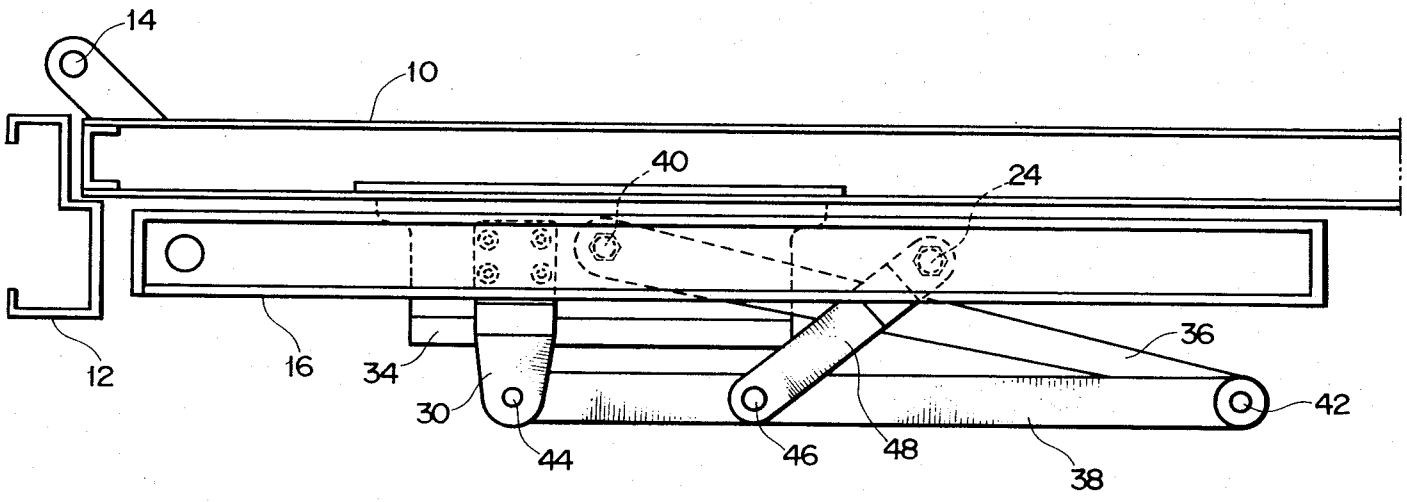
FIG. 1 is a plan view showing a closing apparatus embodying the invention wherein the fireproof door is closed.
Figure 2:
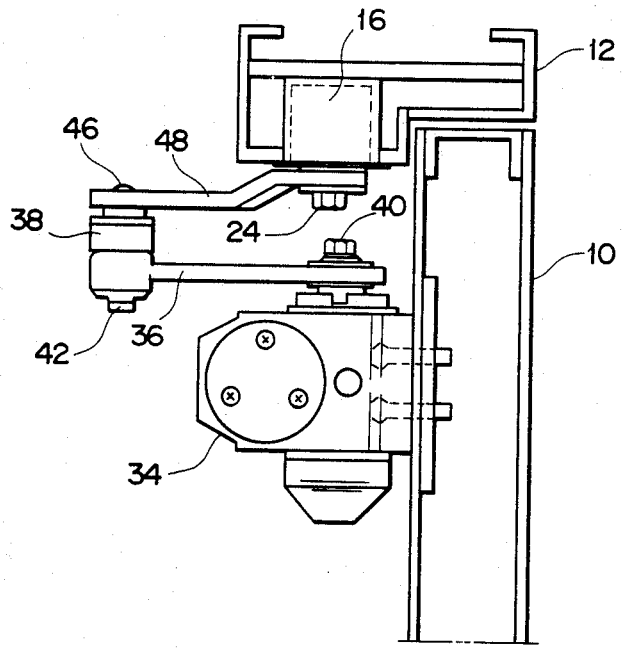
FIG. 2 is a side view showing the closing apparatus illustrated in FIG. 1.

Referring to FIG. 1, reference numeral 10 designates a fireproof door pivotally mounted by hinges 14 on a door frame 12, a crossbeam of which carries, as shown in FIG. 2, a locking device 16.

Figure 3:
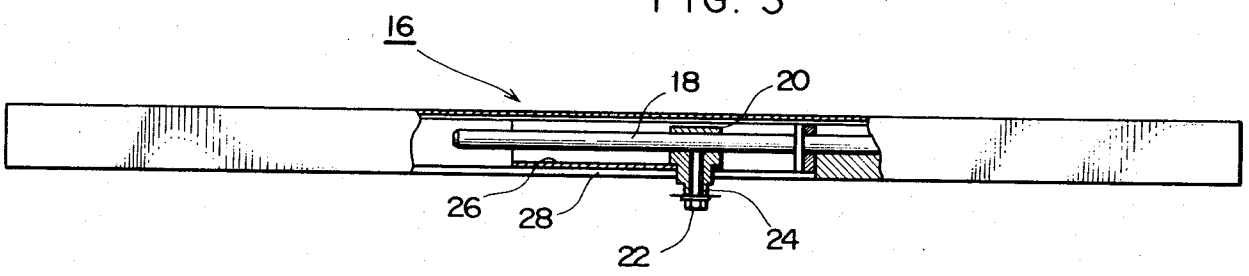
FIG. 3 is a partly-cut away sectional view showing a slider in a locking device wherein a slider is locked.
Figure 4:
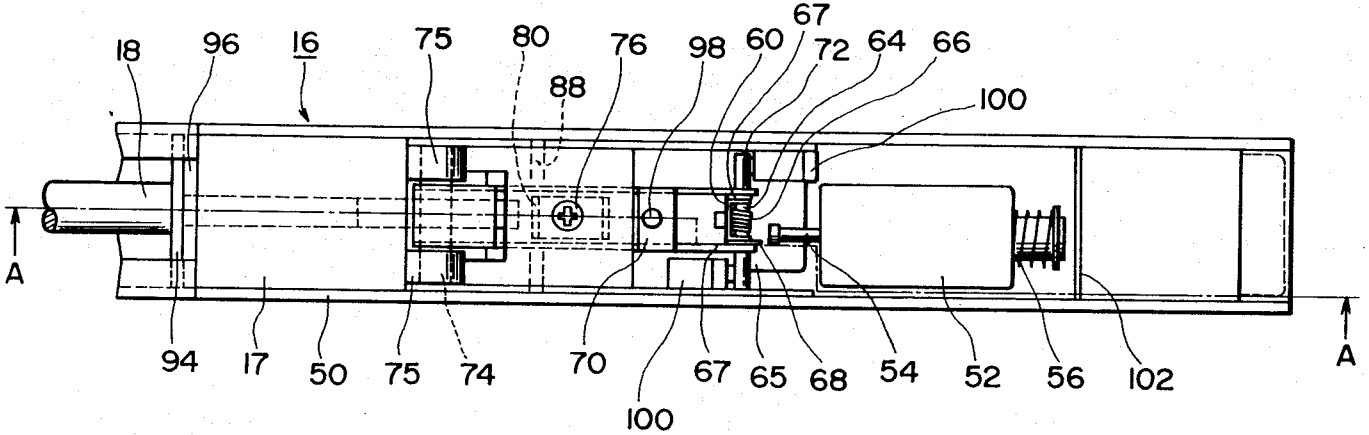
FIG. 4 is a schematic plan view showing a latch mechanism in a locking device.

The locking device 16 includes, as illustrated in FIG. 3, a slide hook 18 slidably guided therein. A slide support 20 is fixedly clamped on the slide hook 18. The lower extension of the slide support 20 is formed as a link mounting shaft 24. A guide plate 26 is fixedly arranged within a housing for guiding the slide support 20 link mounting shaft 24 of the slide support 20 externally projects through an opening 28 formed in a bottom side of the housing.

A link mechanism connecting the locking device 16 and the fireproof door 10 comprises a stationary arm 30 fixed to the locking device 16 on its bottom side, a first link arm 36, a second link arm 38 and a third link arm 48. The first link arm 36 is connected to pivots 40 and 42 and the second link arm 38 is connected to pivots 42 and 44. One end of the third link arm 48 is connected by a pivot 46 to the midway portion of the second link arm 38 and the other end thereof is pivotally supported by the link mounting shaft 24 of the slide support 20 externally projecting through the bottom side of the locking device 16.

FIGS. 4 to 7 illustrate a latch mechanism arranged within the locking device 16.

Figure 5:
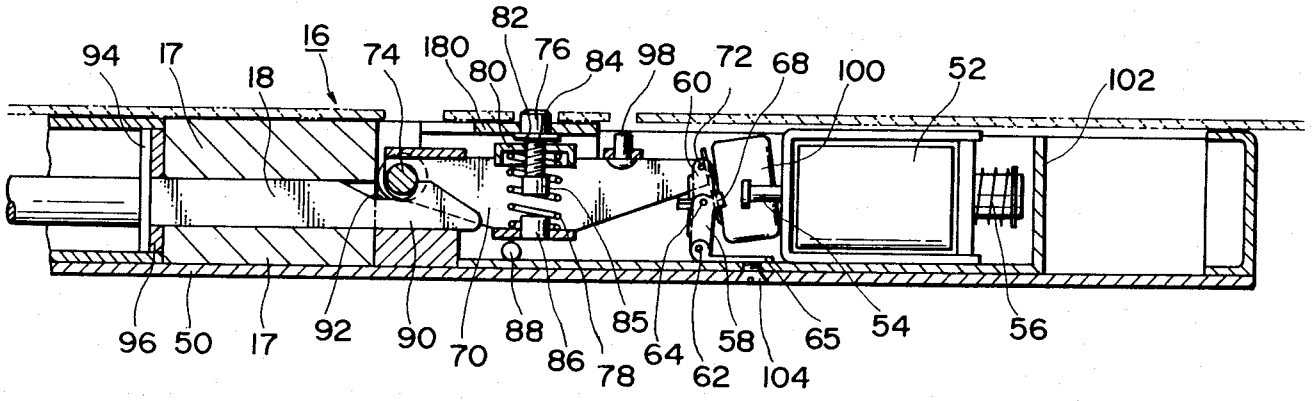
FIG. 5 is a sectional view taken along a line A—A in FIG. 4.

Reference numeral 50 designates a housing of the locking device 16. A solenoid 52, provided with plunger 54 adapted to be projected outward upon energization of the solenoid 52 and to be retracted upon de-energization of the solenoid 52 by a plunger spring 56 mounted on a rear end thereof. Solenond 52 is arranged near one end of device 16 inside the housing 50. A toggle link mechanism comprising a pair of links 58 and 60 having square-U-shape cross-sections and connected by a central toggle pin 64 are mounted facing the plunger 54. The lower link 58 is connected at its lower end by a toggle pin 62 to a link bearing plate 65 fixed to the housing 50 and a toggle spring 66 is mounted on the central toggle pin 64, so that the links are normally biased into linear condition as shown in FIG. 5. The lower link 58 further includes, at a position level with the plunger 54, a stop 68 formed integrally with the link 58, on which the plunger 54 impacts when the latter is extended upon energization of solenoid 52.

Immediately adjacent the toggle link mechanism, there is provided actuator plate 70. The actuator plate 70 is pivotally supported at one end thereof by a toggle pin 72 and a spacer 67 on the link 60, and is provided at the other end with a support pin 74 which carriers on opposite its ends a pair of rollers 75. The rollers 75 roll along the end surface of a guide block 17 mounted in the housing 50 when the actuator plate 70 swings.

The actuator plate 70 is mounted inside the housing 50 by an adjustment screw 76 and a spring 78. The head portion of the adjustment screw 76 is inserted through the housing 50 from its inner side and then prevented by a flange 82 from falling off. The threaded shank 84 of the adjustment screw 76 is threaded through a spring holder plate 80 shaped as upwardly-opening-square-U and is provided at its front end with retaining means 85 fixed thereto. The actuator plate 70 consists of a single sheet folded into a box-like configuration and one of its upper joint edges is folded so as to form a spring support 86 integral with the actuator plate 70. The previously mentioned spring 78 is suspended between the spring support 86 and the spring holder plate 80.

Thus, the actuator plate 70 is swingably supported by the adjustment screw 76 and the spring 78 in a floating condition relative to the housing 50. A resilient force of the spring 78 is adjustable by shifting the spring holder plate 80 by rotating the adjustment screw 76. Such resilient adjustment of the spring 78 by the adjustment screw 76 makes it possible to determine a force necessary to manually release the slide hook 18 from the latch mechanism.

Above the actuator plate 70 a fulcrum shaft 88 is arranged as being spaced from the actuator plate 70, so that the fulcrum shaft 88 provides a fulcrum around which the actuator plate 70 can be rotated when the toggle link mechanism is collapsed by the impact of the plunger 54 upon energization of the solenoid 52 or when the slide hook 18 is subjected to a manual closure force. Actuator plate 70 disengages the support pin 74 from the slide hook 18. The slide hook 18 is adapted to be locked with respect to the support pin 74 by engagement of said support pin 74 into a hook groove 92 defining a hook portion 90 on a front end of the slide hook 18. The slide hook 18 further includes a flange 94 adapted to bear against a slide hook stop 96 mounted on the housing 50 and thereby to position the slide hook 18 relative to the locking mechanism.

Reference numeral 98 designates a restoration assurance pin which is visible from the exterior when the slide hook 18 is engaged with the support pin 74 so as to assure that the fireproof door is locked in its open position.

The solenoid 52, the toggle link mechanism, the actuator plate 70 and the other members arranged inside the locking device 16 are mounted on an inner frame 102 which is in turn mounted by screws 104 on the housing 50. Reference numeral 100 designates limit switches selectively coming in contact with the toggle pin 72 and, more specifically, the limit switches 100 are activated when the toggle link mechanism is collapsed in V-shape upon disengagement of the slide hook 18 from the support pin 74.

The above described closing apparatus operates as follows.

Figure 6:
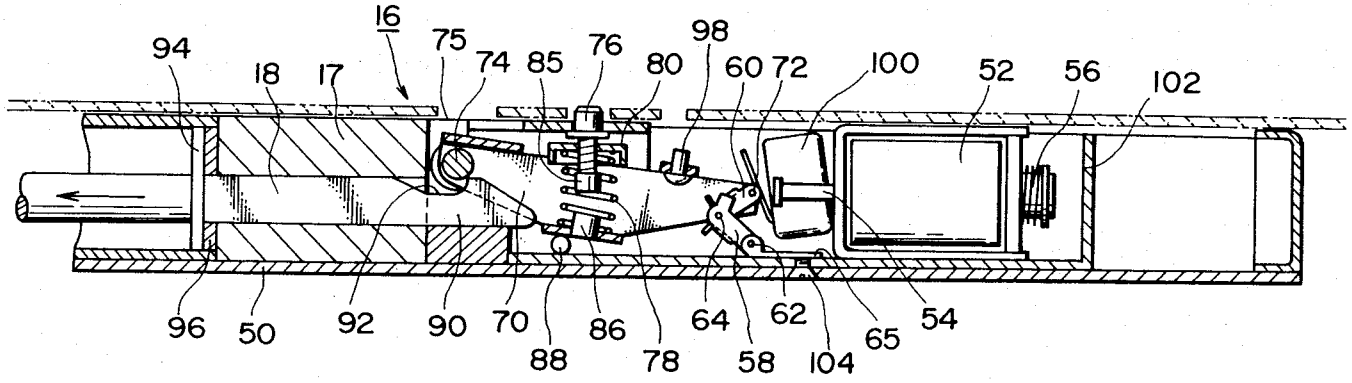
FIG. 6 is a side sectional view showing a latch mechanism in a locking device wherein a slider is unlocked.
Figure 7:
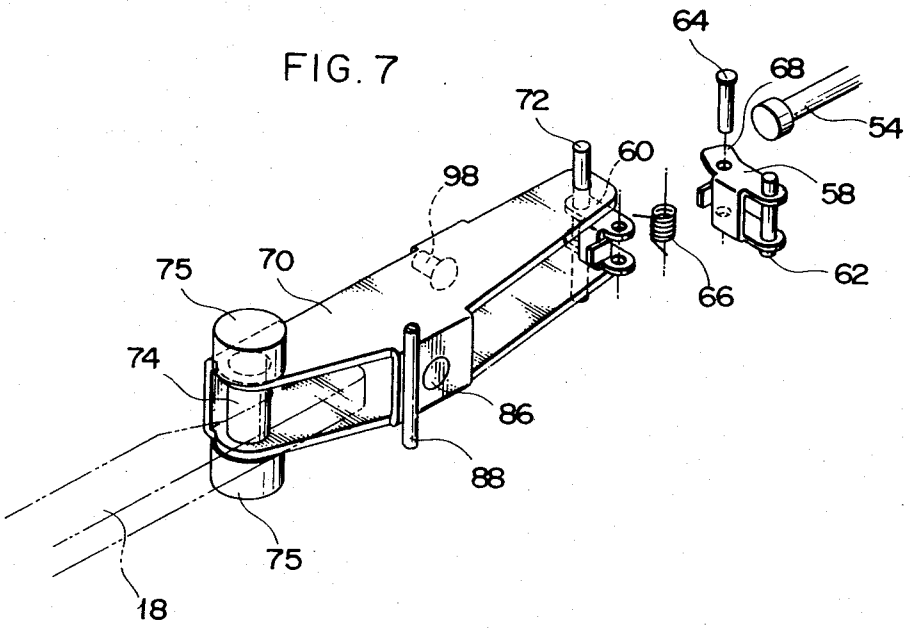
FIG. 7 is a perspective view showing a latch mechanism.

Slide hook 18 is locked to maintain the fireproof door open as long as the hook groove 92 defining the hook portion 90 at the front end of the slide hook 18 remains engaged around the support pin 74 of the actuator plate 70 as shown in FIG. 5. In order to close the fireproof door, the solenoid 52 is energized from a remote site to thrust the plunger 54 forward. The plunger 54 thus thrusted forward strikes stop 68 and collapses the toggle link mechanism into V-shape around the toggle pin 62. Such collapse of the toggle link mechanism causes the actuator plate 70 to swing, as illustrated in FIG. 6, in the clockwise direction, as the rollers 75 carried by the support pin 74 roll on the end surface of the guide block 17 as plate 70 bears against the fulcrum shaft 88. Thus, the support pin 74 is rotated around the fulcrum shaft 88 away from engagement with the hook groove 92 of the slide hook 18 and slide hook 18 is, thereby, released. The third link 48 thereby becomes free and permits the fireproof door 10 to be rotated in the closing direction under a force exerted by the door closer 34. Obviously, the actuator plate 70 is brought back to its horizontal position by the spring 78 after the slide hook 18 has been released. Collapse of the toggle link mechanism activates the limit switches 100 which then output a signal indicating that the locking condition has been removed.

When the fireproof door is manually toward its closed position, third link 48 will apply a force to slide hook 18 to move it to the left (as viewed in FIG. 5). Under this force, hook groove 92 of the slide hook 18 is displaced to urge the support pin 74 out of groove 92. As a result, the actuator plate 70 swings around the fulcrum shaft 88 against the biasing force of the spring 78 to release the door.

The biasing force of the spring 78 is adjustable by the adjustment screw 76. Accordingly, the closure force necessary to release the slide hook 18 can be selectively adjusted by presetting the resilient force of spring 78, i.e., the extension of the adjustment screw 76 from plate 80.

Thus, with the closing apparatus as above described, even if a remote actuation malfunctions, the fireproof door can be assuredly closed simply by pulling the door. Furthermore, it is possible to obtain an appropriate unlocking force (or a closure force) individually suited to each particular size of the fireproof door.

What is claimed is:

1. A door hold-open apparatus comprising:

a support housing adapted for attachment to a door frame;

a slider bar having a longitudinal axis and movably received in said support housing for movement therein along the slider bar longitudinal axis and adapted to be coupled to a door which is movable relative to said support housing between a door open and a door closed position, said slider bar having a first latching element;

an elongated actuator mechanism movably coupled to said support housing with its direction of elongation being substantially parallel to said longitudinal axis of the slider bar so to be tiltable about a tilt axis substantially perpendicular to the longitudinal axis of the slider bar, said actuator mechanism having a second latching element and being tiltable between a latching position in which the first and second latching elements are in releasable engagement with each other to prevent movement of the slider bar so that the door is kept in its open position and a release position in which the first and second latching elements are disengaged to release the slider bar for movement within the support housing so that the door can be closed, wherein the actuator mechanism comprises a body elongated along the longitudinal axis of said slider bar, the second latching element being disposed at one end of said body, and said member being connected to the other end of said body;

moving means secured in said support housing for moving said actuator mechanism between the latching position and the release position to disengage the first and second latching elements, said moving means comprising a solenoid and opposed, engaged surface means on said first and second latching elements angled for enabling sliding movement therebetween in a direction tangential to a locus of points defining a circle about said tilt axis of said actuator mechanism as the slider bar moves along its longitudinal axis away from the actuator mechanism to force the actuator mechanism to its said release position, said moving means further comprising a member means connected to the actuator mechanism for tilting the actuator mechanism from the latch position to the release position upon said member means being struck by a plunger of said solenoid, said member means being positioned relative to said solenoid within striking distance of the plunger of said solenoid, wherein said member comprises two linked elements having a center portion in which the two elements are rotatably coupled and two remote ends one of which is connected to the other end of said body and the other of which is connected to the support housing, said linked elements being shiftable by said solenoid between an extended position in which said one remote end is spaced a first distance from the other remote end and a collapsed position in which said one remote end is spaced a second distance shorter than the first distance from the other remote end, one of said extended and collapsed positions corresponding to the latching position of said actuator mechanism and the other corresponding to the release position of said actuator mechanism;

mounting means for tiltably coupling the actuator mechanism to the support housing for movement between said latching position and said release position, and including resilient means having a spring, coupled to the actuator mechanism for adjustably applying a resilient force opposing tilting of the actuator mechanism from said latching position to said release position, and bias adjustment means for adjusting spring tension in said spring; and detecting means actuated by said member for sensing movement of the actuating member from said latching position to said release position and to indicate that the actuator mechanism has been displaced from the latching position.

2. The door hold-open apparatus of claim 1, wherein said member further includes resilient means for biasing said linked elements into one of said extended and collapsed positions.

3. The door hold-open apparatus of claim 2, wherein the actuator mechanism is in its latching position when said linked elements are in the extended position.

4. The door hold-open apparatus of claim 1, wherein the support housing is elongated, and the slider bar, actuator mechanism, and moving means are positioned within said support housing in series along the axial direction of the slider bar.

5. The door hold-open apparatus of claim 1, wherein said moving means comprises corresponding engaged surface means on the first and second latching elements, respectively, for disengaging the first and second latching elements in response to manual force applied to the door to move it from the open position to the closed position.

6. A door hold-open apparatus comprising:

a support housing adapted for attachment to a door frame;

a slider bar having a longitudinal axis and movably received in said support housing for movement therein along the slider bar longitudinal axis and adapted to be coupled to a door which is movable relative to said support housing between a door open and a door closed position, said slider bar having a first latching element;

an elongated actuator mechanism movably coupled to said support housing with its direction of elongation being substantially parallel to said longitudinal axis of the slider bar so as to be tiltable about a tilt axis substantially perpendicular to the longitudinal axis of the slider bar, said actuator mechanism having a second latching element and being tiltable between a latching position in which the first and second latching elements are in releasable engagement with each other to prevent movement of the slider bar so that the door is kept in its open position and a release position in which the first and second latching elements are disengaged to release the slider bar for movement within the support housing so that the door can be closed;

moving means secured in said support housing for moving said actuator mechanism between the latching position and the release position to disengage the first and second latching elements, wherein said moving means further comprises a member means connected to the actuator mechanism for tilting the actuator mechanism from the latching position to the release position upon said member means being struck by a plunger of said solenoid, said member means being positioned relative to said solenoid within striking distance of the plunger of said solenoid, and wherein said member comprises two linked elements having a center portion in which the two elements are rotatably coupled and two free ends one of which is connected to the other end of said body and the other of which is connected to the support housing, said linked elements being shiftable by said solenoid between an extended position in which said one free end is spaced a first distance from the other free end and a collapsed position in which said one free end is spaced a second distance shorter than the first distance from the other free end, one of said extended and collapsed positions corresponding to the latching position of said actuator mechanism and the other corresponding to the release position of said actuator mechanism; and mounting means for tiltably coupling the actuator mechanism to the support housing for movement between said latching position and said release position, and including resilient means having a spring, coupled to the actuator mechanism for adjustably applying a resilient force opposing tilting of the actuator mechanism from said latching position to said release position.

7. The door hold-open apparatus of claim 6, wherein said member further includes resilient means for biasing said linked elements into one of said extended and collapsed positions.

8. The door hold-open apparatus of claim 7, wherein the actuator mechanism is in its latching position when said linked elements are in the extended position.

* * * * *